US006706331B2

(12) United States Patent
Clancy et al.

(10) Patent No.: US 6,706,331 B2
(45) Date of Patent: Mar. 16, 2004

(54) COLD-FORMABLE METAL-COATED STRIP

(75) Inventors: Catherine Clancy, Yarraville (AU); Ian Miles Robertson, Wollongong (AU)

(73) Assignee: BHP Steel (JLA) Pty Ltd, Sydney (AU)

( * ) Notice: Subject to any disclaimer, the term of this patent is extended or adjusted under 35 U.S.C. 154(b) by 48 days.

(21) Appl. No.: 10/073,048

(22) Filed: Feb. 12, 2002

(65) Prior Publication Data

US 2003/0152796 A1 Aug. 14, 2003

(51) Int. Cl.[7] ..... B21D 33/00; B05D 1/18; B05D 1/00

(52) U.S. Cl. ..... 427/436; 427/431; 427/435; 427/355; 427/359; 427/360; 427/367; 29/17.2; 72/365.2

(58) Field of Search ..... 427/178, 355, 427/359, 360, 365, 367, 368, 383.1, 388.1, 431, 435, 436; 29/17.1, 17.2, 17.3; 72/365.2, 379.2

(56) References Cited

U.S. PATENT DOCUMENTS 4,067,215 A * 1/1978 Nakajima et al. ..... 72/40
2001/0007280 A1 * 7/2001 Claessens et al. ..... 164/476

FOREIGN PATENT DOCUMENTS

EP 0 074 918 A 3/1983
EP 0 611 669 A 8/1994
GB 1 489 618 A 10/1977
GB 2 122 650 A 1/1984

OTHER PUBLICATIONS

Japanese Patent Abstract, vol. 15, No. 038 (C–0800), Jan. 30, 1991 and JP 02 274858 A (Kawasaki Steel Corp), Nov. 9, 1990.
Japanese Patent Abstract, vol. 013, No. 523 (C–657), Nov. 21, 1989 and JP 01 212744 A (Sumitomo Metal Mining Co Ltd), Aug. 25, 1989.
Japanese Patent Abstract, vol. 014, No. 299 (C–0733), Jun. 27, 1990 and JP 02 097655 A (Sumitomo Metal Ind Ltd), Apr. 10, 1990.
Japanese Patent Abstract, vol. 1999, No. 01, Jan. 29, 1999 and JP 10 280086 A (Nippon Steel Corp.), Oct. 20, 1998.
Japanese Patent Abstract, vol. 1998, No. 13, Nov. 30, 1998 and JP 10 226858 A (Nippon Steel Corp.), Aug. 25, 1998.
Japanese Patent Abstract, vol. 1996, No. 2, Feb. 29, 1996 and JP 07 256342 A (Nippon Steel Corp.), Oct. 9, 1995.
Publication No. 60–106918 (JP 60106918 a), Jun. 12, 1985 "Manufacture of Alloyed Hot–Galvanized Steel Sheet", Nakamori Toshio and Shibuya Atsuyoshi.

* cited by examiner

*Primary Examiner*—Michael LaVilla
(74) *Attorney, Agent, or Firm*—Miles & Stockbridge P.C.; John C. Kerins

(57) ABSTRACT

A method of producing a metal-coated steel strip includes the steps of forming a metal coating on a steel strip and conditioning the surface of the metal-coated steel strip by smoothing the surface of the strip. The method is characterised in that the conditioning step produces residual stress of no more than 100 MPa in the strip.

24 Claims, 3 Drawing Sheets

Residual stress level at different positions through the thickness of strip.

Effect of levelling extension on maximum residual stress level (residual stress near the mid-thickness position).

FIG.4

Maximum tensile residual stress at different positions across the width of levelled strip.

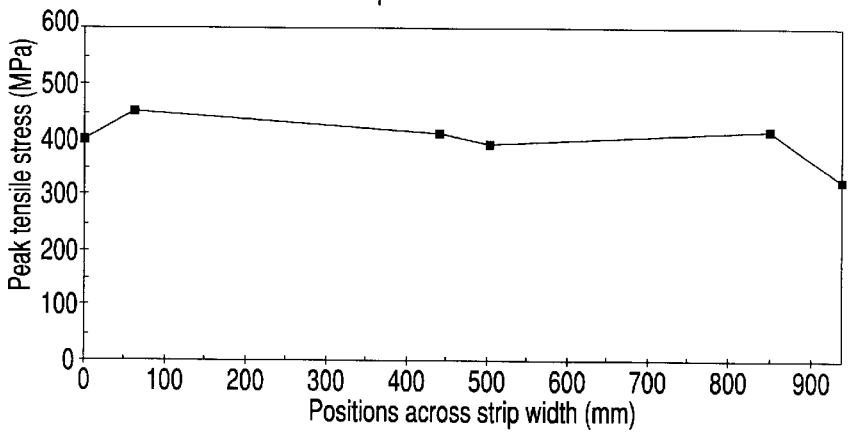

FIG.5

Increase in edge ripple height with increasing residual stress during operation of a roll-forming machine on three different days.

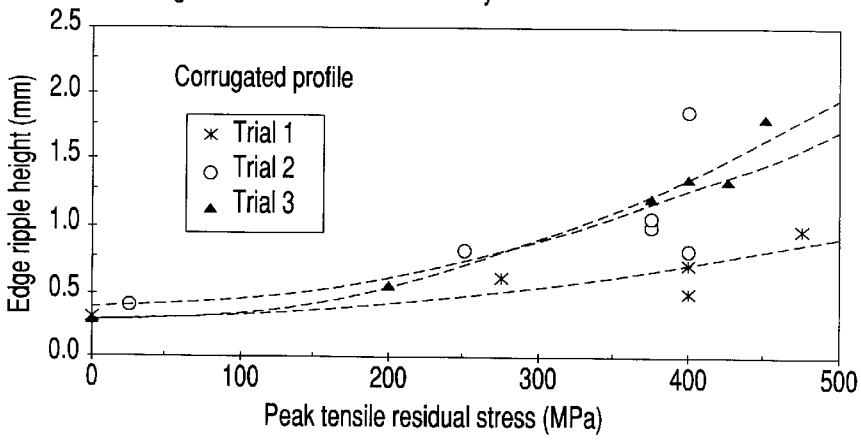

FIG.6

Edge ripple height measured on sheets of a roll-formed profile produced from a coil levelled for part of its length but not levelled for the remainder.

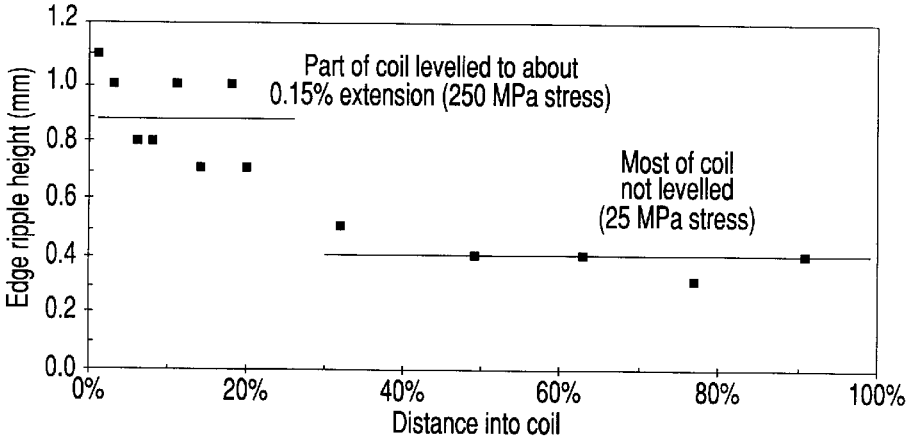

COLD-FORMABLE METAL-COATED STRIP

BACKGROUND OF THE INVENTION

1. Field of the Invention

The present invention relates to cold-formable steel strip that has a corrosion-resistant coating.

2. Description of Related Art

The present invention relates particularly but not exclusively to steel strip that has a corrosion-resistant metal coating and can be painted and thereafter cold formed (e.g. by roll forming) into an end-use product, such as roofing products.

The present invention relates particularly but not exclusively to a corrosion-resistant metal coating in the form of an aluminium/zinc alloy.

The present invention relates particularly but not exclusively to high tensile strength steel strip.

The term "high tensile strength" is understood herein to mean that the tensile strength is at least 350 MPa.

The present invention relates particularly but not exclusively to metal-coated steel strip that is produced by a hot-dip coating method.

In the hot-dip metal coating method, steel strip generally passes through one or more heat treatment furnaces and thereafter into and through a bath of molten coating metal held in a coating pot. The coating metal is usually maintained molten in the coating pot by the use of heating inductors. The strip usually exits the heat treatment furnaces via an elongated furnace exit chute or snout that dips into the bath. Within the bath the strip passes around one or more sink rolls and is taken upwardly out of the bath. After leaving the coating bath the strip passes through a coating thickness station, such as a gas knife or gas wiping station at which its coated surfaces are subjected to jets of wiping gas to control the thickness of the coating. The coated strip then passes through a cooling section and is subjected to forced cooling. The cooled strip thereafter passes successively through a skin pass rolling section (also known as a temper rolling section) and a levelling section. The main purpose of skin pass rolling the strip is to condition the strip surface (with minimal thickness reduction) to smooth the surface. An additional benefit of skin pass rolling is to flatten surface defects, such as pin-holes and surface dross, when such surface defects are present. The purpose of levelling the strip is to deform the strip so that it is sufficiently flat for subsequent processing, for example in a paint coating line operating at high speed (i.e. at least 100 m/min). The skin pass rolled and levelled strip is coiled at a coiling station.

A major market for metal-coated, particularly zinc/aluminium coated, steel strip is as a feedstock for paint lines that apply a paint coating to the surface of the steel strip. Paint line products have a range of commercial applications and in the majority of cases it is necessary to cold form (such as by roll forming) the painted strip in order to produce final end-use products, such as roofing products.

It is important that metal-coated steel strip that is produced by a metal coating line, such as a hot-dip metal coating line, for use ultimately as a cold forming feedstock be produced reliably with properties that confer adequate formability under the cold forming operation. More particularly, providing cold forming operators with coils of painted metal-coated steel strip feedstock that behave consistently and reliably during a cold forming operation is an important consideration for the operators. Specifically, consistent quality cold forming feedstock enables operators to produce cold-formed product of a consistently high quality without having to make significant adjustments to cold forming equipment to compensate for coil to coil variations in the cold forming properties of the strip.

Cold formability of painted metal-coated steel strip feedstock becomes increasingly important with higher tensile strength steel strip, which is inherently more difficult to cold form.

A general object of the present invention is to provide a method of producing cold-formable, metal-coated, steel strip consistently and reliably.

A more particular object of the present invention is to provide a method of producing metal-coated steel strip that has high quality surface finish and consistent and reliable cold formability compared to currently available steel strip.

SUMMARY OF THE INVENTION

In the context of the present invention, the criteria according to which cold formability is assessed include:

(i) quality of the roll-formed profile—considered in relation to parameters such as severity of imperfections, two of which are oil canning and edge ripple;

(ii) performance in a roll former; and (iii) consistency of the form and shape of the roll formed profile.

According to the present invention there is provided a method of producing a metal-coated steel strip which includes the steps of:

(a) forming a metal coating on a steel strip; and (b) conditioning the surface of the metal-coated steel strip by smoothing the surface of the strip, the conditioning step producing residual stress of no more than 100 MPa in the strip.

According to the present invention there is also provided a method of producing a metal-coated steel strip which includes the steps of:

(a) forming a metal coating on a steel strip;

(b) conditioning the surface of the metal-coated steel strip by smoothing the surface of the strip, the conditioning step producing residual stress of no more than 100 MPa in the strip; and (c) forming a paint coating on the conditioned strip.

The present invention is based on the realisation that residual stress in metal-coated steel strip, particularly high tensile strength steel strip, causes problems during cold forming (such as roll forming) the strip.

In particular, the present invention is based on the realisation that the conventional practice of levelling metal-coated steel strip, particularly high tensile strength steel strip, that has been skin pass rolled can introduce considerable amounts of residual stress in the strip and thereby affect adversely the cold formability of the strip.

More particularly, the present invention is based on the realisation that rolling metal-coated steel strip, particularly high tensile steel strip, in order to condition the surface of the strip (by deforming the strip to produce a smooth surface) should be carried out under rolling conditions that produce minimal residual stress within the strip.

In the context of the present invention, "minimal residual stress" is understood to mean residual stress of no more than 100 MPa.

In addition, in the context of the present invention, "residual stress" is understood to mean the residual stress through the thickness of the strip. Accordingly, references to "residual stress" herein should be understood as references to through-thickness residual stress.

It is relevant to note that there are two distributions of residual stress in strip. One is the through-thickness distribution mentioned in the preceding paragraph and the other is the distribution of residual stress across the width of the strip. The across-width distribution of residual stress is usually of small magnitude in the case of thin strip.

Preferably, step (b) of conditioning steel strip produces residual stress of no more than 90 MPa through the thickness of the strip.

The applicant has found that producing metal-coated steel strip, particularly high tensile strength steel strip, with minimal residual stress makes it possible to consistently and reliably roll form the strip.

Preferably the steel strip is high tensile strength steel strip.

Preferably the tensile strength of the steel strip is at least 400 MPa.

More preferably the tensile strength of the steel strip is at least 450 MPa.

Preferably step (a) of forming the metal coating on the steel strip includes recovery annealing the strip before forming the metal coating on the strip.

Preferably step (a) of forming the metal coating on the steel strip includes hot-dip metal coating the strip in a bath of molten coating metal.

Preferably step (a) of forming the metal coating on the steel strip includes the steps of recovery annealing steel strip, thereby producing high tensile strength steel strip, and thereafter hot-dip metal coating the strip.

The term "recovery-annealing" is understood herein to mean heat treating steel strip so that the microstructure undergoes recovery with minimal, if any, recrystallisation, with such recrystallisation being confined to localised areas such as at the edges of the strip.

Preferably step (b) of conditioning the steel strip smoothes the surface of the steel strip so that it is suitable for painting in a paint line.

Preferably step (b) of conditioning the steel strip smoothes the surface of the steel strip so that it is sufficiently smooth for painting in a paint line operating at least at 80% of its rated maximum production line speed.

Preferably step (b) of conditioning steel strip maintains the strip sufficiently flat for painting in a paint line.

The term "sufficiently flat" is understood herein in the context of complying with appropriate national standards, such as Class A and Class B flatness specified in Standard AS/NZ 1365.

Preferably step (b) of conditioning the steel strip includes rolling the strip.

The rolling conditions may be selected as required to condition the surface of the strip and to produce residual stress of no more than 100 MPa.

Preferably the rolling conditions are selected to produce residual stress of no more than 60 MPa.

More preferably the rolling conditions are selected to produce residual stress of no more than 50 MPa.

More preferably the rolling conditions are selected to produce residual stress of no more than 30 MPa.

Appropriate rolling control parameters include, by way of example, any one or more of:

(i) strip extension;

(ii) roll force;

(iii) roll bending; and (iv) entry and exit tension.

Preferably the metal-coated steel strip has a thickness of no more than 1 mm.

More preferably the metal-coated steel strip has a thickness of no more than 0.6 mm.

According to the present invention there is also provided a metal-coated steel strip having a residual stress of no more than 100 MPa.

Preferably the steel strip is high tensile strength steel strip.

Preferably the tensile strength of the steel strip is at least 400 MPa.

More preferably the tensile strength of the steel strip is at least 450 MPa.

According to the present invention there is also provided a metal-coated steel strip that is suitable for use as a feedstock for a paint coating line and has a residual stress of no more than 100 MPa.

Preferably the steel strip is high tensile strength steel strip.

Preferably the tensile strength of the steel strip is at least 400 MPa.

More preferably the tensile strength of the steel strip is at least 450 MPa.

According to the present invention there is also provided a feedstock for a paint coating line produced by the above-described method.

Preferably the feedstock is high tensile strength steel strip.

Preferably the tensile strength of the steel strip is at least 400 MPa.

More preferably the tensile strength of the steel strip is at least 450 MPa.

According to the present invention there is also provided a painted, metal-coated, steel strip having a residual stress of no more than 100 MPa.

Preferably the steel strip is high tensile strength steel strip.

Preferably the tensile strength of the steel strip is at least 400 MPa.

More preferably the tensile strength of the steel strip is at least 450 MPa.

BRIEF DESCRIPTION OF THE DRAWINGS

The present invention is described further by way of example with reference to the accompanying drawings of which:

FIGS. 2 to 6 are a series of plots that summarise the results of trials carried out by the applicant to evaluate the present invention.

DETAILED DESCRIPTION OF THE PREFERED EMBODIMENTS

Figure 1:
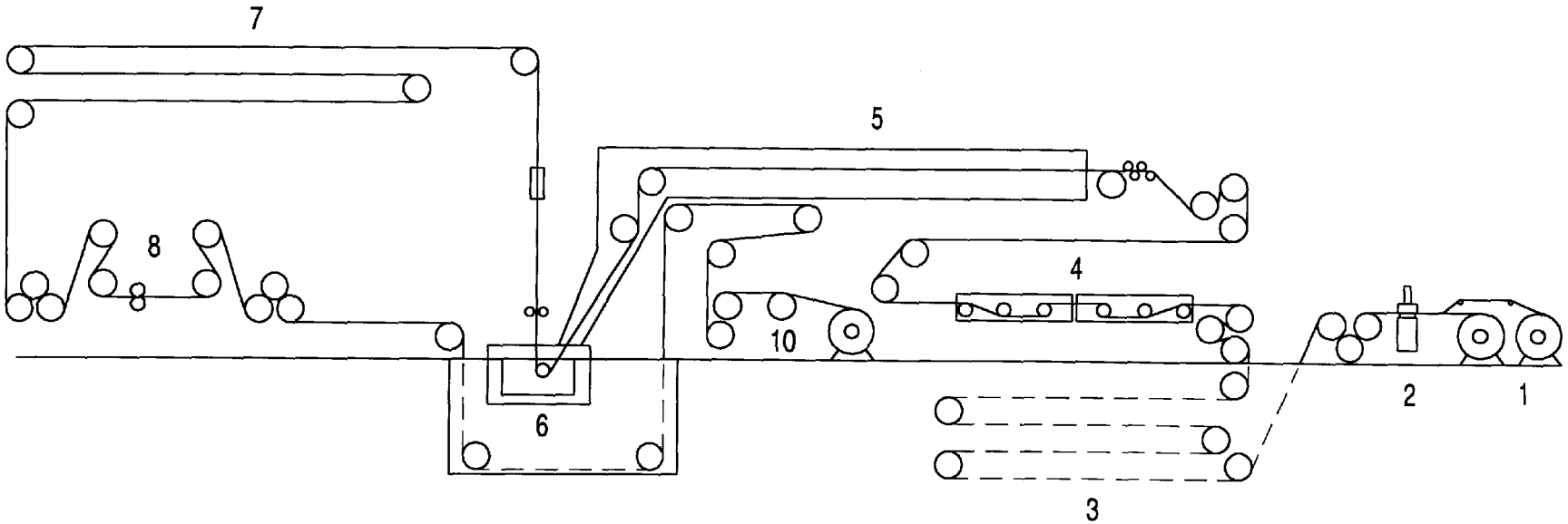
FIG. 1 is a schematic drawing of one embodiment of a continuous production line for producing coated metal strip in accordance with the method of the present invention.

With reference to FIG. 1, in use, coils of cold rolled steel strip are uncoiled at an uncoiling station 1 and successive uncoiled lengths of strip are welded end to end by a welder 2 and form a continuous length of strip.

The strip is then passed successively through an accumulator 3, a strip cleaning section 4 and a furnace assembly 5. The furnace assembly 5 that includes a preheater, a preheat reducing furnace, and a reducing furnace.

The strip is heat treated in the furnace assembly 5 by careful control of process variables including:(i) the temperature profile in the furnaces, (ii) the reducing gas concentration in the furnaces, (iii) the gas flow rate through the furnaces, and (iv) strip residence time in the furnaces (ie line speed).

The process variables in the furnace assembly 5 are controlled so that there is recovery annealing of the steel to produce high tensile strength strip, removal of oxide coatings from the surface of the strip, and removal of residual oils and iron fines from the surface of the strip.

The heat treated strip is then passed via an outlet spout downwardly into and through a bath of molten coating metal held in a coating pot 6 and is coated with metal. The coating metal is maintained molten in the coating pot by use of heating inductors (not shown). Within the bath the strip passes around a sink roll and is taken upwardly out of the bath.

After leaving the coating bath 6 the strip passes vertically through a gas wiping station (not shown) at which its coated surfaces are subjected to jets of wiping gas to control the thickness of the coating.

The coated strip is then passed through a cooling section 7 and subjected to forced cooling.

The cooled, coated strip is then passed through a rolling section 8 that conditions the surface of the coated strip by smoothing the surface of the strip under rolling conditions that produce minimal residual stress, ie no more than 100 MPa, in the strip.

The coated strip is thereafter coiled at a coiling station 10.

The rolling section 8 may be of any suitable configuration.

By way of example, the rolling section 8 may be a conventional skin pass rolling assembly, such as a four high mill, of an existing metal coating line which is controlled to operate under rolling conditions that produce required surface conditioning and flatness of the strip, and minimal residual stress.

By way of further example, the rolling section 8 may be a conventional skin pass rolling assembly and downstream leveller assembly of an existing metal coating line which are controlled to operate under rolling conditions that produce required surface conditioning and flatness, and minimal residual stress.

By way of particular example, the rolling section 8 may be a conventional skin pass rolling assembly and anti-camber stages of a conventional downstream leveller assembly of an existing metal coating line which are controlled to operate under rolling conditions that produce required surface conditioning and flatness, and minimal residual stress.

The rolling conditions may be defined by any suitable rolling parameters having regard to the end-use application of the strip and the intermediate processing that may be required to produce the end-use product. In this context, the end-use application and required intermediate strip processing (such as painting the strip) may make it necessary for the rolling conditions to take into account other properties, such as strip flatness.

Where strip flatness is a particular issue, as typically would be the case where the strip is to be painted, it may be appropriate to carry out a two step rolling operation with the second step being principally concerned with producing flat strip while maintaining less than 100 MPa residual stress.

Typically, the rolling conditions in the rolling section 8 may be defined by reference to the parameters of strip extension, roll force, roll bending and strip tension (in situations where the rolling section 8 includes entry/exit bridles).

In one coating line of the applicant, the preferred rolling conditions in the rolling section 8 (a skin pass rolling assembly) for processing strip having a thickness of 0.42 mm and a width of 940 mm in accordance with the present invention are as follows:

(i) extension: no more than 1% and preferably no more than 0.2%;

(ii) roll force: no more than 4 MN;

(iii) roll bending (expressed as force applied to the rolls): 250 kN; and (iv) entry bridle tension: 40–45 kN.

The above-described rolling conditions are typical rolling conditions to produce surface conditioning and flatness required for metal-coated steel strip in the form of zinc/aluminium coated steel strip that is suitable for use as a feedstock for a paint coating line operating at least at 50 m/min, more preferably 100 m/min.

The applicant evaluated the present invention by means of:

(i) a series of trials carried out at a commercial roll forming plant in Newcastle, NSW, Australia operated by the Building Products Division of the applicant;

(ii) comparisons of the performance on several commercial roll-forming lines of metal coated strip produced in different ways.

The trials at Newcastle were carried out on three different days on strip having a base metal thickness of 0.42 mm and a width of 940 mm, producing roll formed sheets with a corrugated profile. The comparisons on other roll-forming lines involved various thicknesses and widths of strip, and various roll-formed profiles (but often gutter and fascia profiles).

The trials evaluated properties of strip that was processed in accordance with standard plant operating conditions involving skin pass rolling and thereafter tension levelling the strip.

The trials also evaluated properties of strip that was processed by conditioning strip under conditions that produced minimal residual stress in the strip in accordance with the present invention. Specifically, the conditions were achieved by skin pass rolling and not tension levelling the strip.

The distribution of residual stress through the thickness of strip is one of the parameters that was measured for strip processed in the trials at Newcastle in in the comparisons at other sites.

The technique used to measure the through-thickness residual stress distribution is based on that described by R G Treuting and W D Read, Journal of Applied Physics, Vol. 22, pp 130–134, 1951. The technique comprises the following steps. A small sample is cut from a steel strip (size is not critical, usually about 50×100 mm). One surface of the sample is progressively etched away in an acidic solution and the other surface is protected from attack by the acid by the previous application of a flexible, acid-resistant coating. The change in curvature of the strip is recorded as the thickness is reduced. The residual stress distribution is calculated from the curvature as a function of the thickness.

The results of the trials and measurements in the laboratory are summarised in FIGS. 2 to 6.

Figure 2:
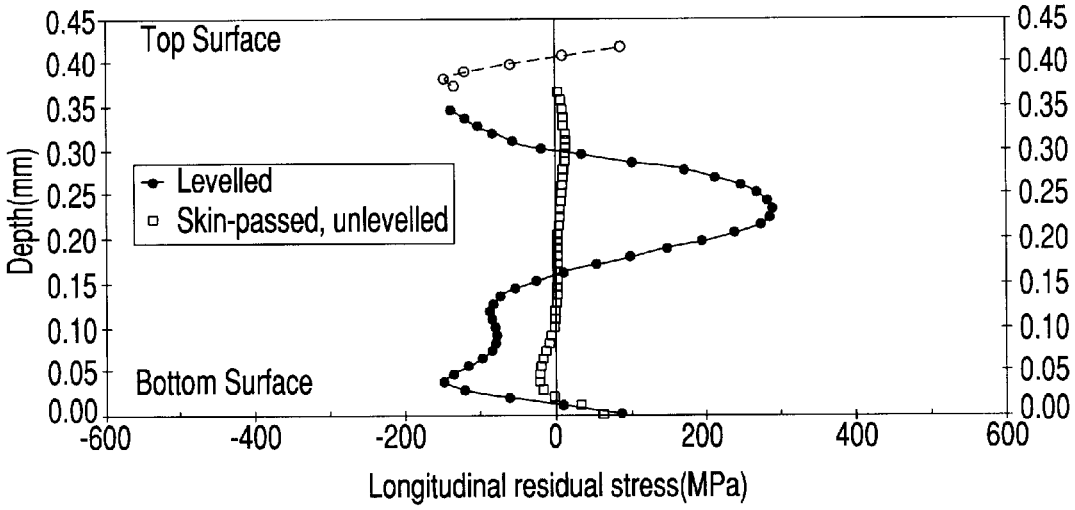

FIG. 2 is a plot of position through the thickness of coated strip (in mm measured from the bottom surface) versus the longitudinal component of residual stress (in MPa) for strip processed in accordance with standard operating conditions (i.e. skin pass rolled and levelled). Tensile stress is regarded as positive and compressive stress as negative.

FIG. 2 is also a plot of position through the thickness of coated strip (in mm measured from a bottom surface) versus the longitudinal component of residual stress (in MPa) for strip processed in accordance with the method of the present invention (achieved by skin pass rolling and not levelling strip).

It is evident from FIG. 2 that the conventional practice of skin pass rolling and levelling the strip introduced substantial residual stress, particularly near the middle of the thickness, with a maximum (or peak) tensile residual stress of approximately 300 MPa and a maximum (or peak) compressive residual stress of approximately 150 MPa.

It is also evident from FIG. 2 that the residual stress in strip could be maintained at a minimal level, i.e. well below 100 MPa (approximately 25 MPa), by skin pass rolling and not subsequently levelling strip.

Figure 3:
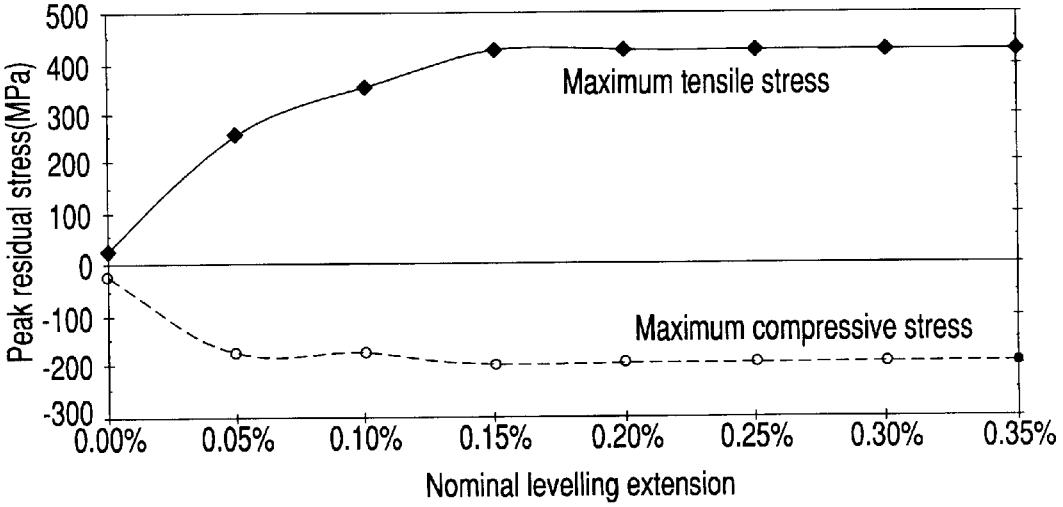

FIG. 3 is a plot of peak tensile and peak compressive residual stress (in MPa) versus nominal levelling extension for strip processed in accordance with standard operating conditions (i.e. skin pass rolled and levelled) over a range of levelling extensions up to 0.35%. The peak tensile and peak compressive stress values were determined from through-thickness measurements at the same position across the width of the strip.

It is evident from FIG. 3 that the peak tensile residual stress increased quickly from approximately 25 MPa to approximately 400 MPa as the levelling extension increased to approximately 0.15% and remained at that level as the levelling extension increased beyond 0.15%. Similarly, it is evident from FIG. 3 that the peak compressive stress increased quickly from approximately 25 MPa to approximately 200 MPa as the levelling extension increased to approximately 0.05% and remained at that level as the levelling extension increased beyond 0.05%.

FIG. 4 is a plot of peak residual stress (in MPa) versus position across the width of strip (in mm) for strip processed in accordance with standard operating conditions (i.e. skin pass rolled and levelled). The peak tensile residual stress values were determined from through-thickness measurements at 6 selected points across the width of the strip.

It is evident from FIG. 4 that the standard practice of skin pass rolling and levelling strip introduced substantial residual stress at all positions across the width of the strip.

FIG. 5 is a plot of edge ripple height (in mm) versus peak tensile residual stress (in MPa) for each of the three separate trials at Newcastle. The peak tensile residual stress values were determined from through-thickness measurements at selected points on the strip.

FIG. 5 records the effect of increasing peak tensile residual stress in strip on edge ripple (waviness of the edge) of the roll formed profile.

Specifically, it is evident from FIG. 5 that in each trial the effect of increasing peak tensile residual stress in strip was to increase the edge ripple height of profile. Edge ripple is one of a number of undesirable physical effects.

Accordingly, FIG. 5 establishes that minimising residual stress (in this instance peak tensile residual stress) is important in terms of minimising edge ripple in strip.

FIG. 6 is a plot of edge ripple height (in mm) versus distance along the length of a coil of strip processed for the first 25–30% of its length in accordance with standard processing conditions (i.e. skin pass rolled and levelled) which introduced a peak residual stress of 250 MPa and thereafter for the remainder of the coil length in accordance with the method of the present invention (i.e. with minimal residual stress).

It is evident from FIG. 6 that edge ripple height was significantly affected by the level of residual stress in strip.

Specifically, it is evident from FIG. 6 that lower levels of residual stress produced profile having significantly lower edge ripple height.

In addition to measurements of edge ripple height at Newcastle, the applicant has observed that the presence of high levels of residual stress in strip is often associated with increased severity of the oil-canning defect in roll formed profiles.

In one particular example, oil-canning (waviness) in the base of a gutter profile was barely detectable in the case of strip with low residual stress. However, for strip with a peak longitudinal residual stress of 400 MPa oil-canning increased to a peak height of 0.3 mm with a wavelength of 160 mm.

In another example, a roll formed channel profile displayed oil canning with a peak height of 0.5 to 0.6 mm when formed from strip with low residual stress, but this increased to 0.8 mm when formed from strip with high residual stress.

Many modifications may be made to the preferred embodiment described above without departing from the spirit and scope of the present invention.

By way of example, whilst the preferred embodiment of the method includes hot-dip metal coating the steel strip, the present invention is not so limited and extends to any suitable method of applying a metal coating to the steel strip.

Furthermore, whilst the preferred embodiment of the method includes recovery annealing steel strip in the furnace assembly 5 (FIG. 1) to produce high tensile strength strip, the present invention is not so limited and extends to high and low tensile strength steel strip and to high tensile strength steel strip that is produced otherwise than by the described recovery annealing step.

Furthermore, whilst the preferred embodiment of the method includes rolling metal-coated steel strip, the present invention is not so limited and extends to any suitable method of conditioning the surface of strip by smoothing the surface without producing residual stress in excess of 100 MPa.

What is claimed is:

1. A method of producing a metal-coated steel strip which includes the steps of:

(a) forming a metal coating on a steel strip; and (b) conditioning the surface of the metal-coated steel strip by smoothing the surface of the strip, the conditioning step producing residual stress of no more than 100 MPa in the strip;

wherein the steel strip is high tensile strength steel strip, and wherein the tensile strength of the steel strip is at least 400 MPa.

2. The method defined in claim 1 wherein step (b) of conditioning steel strip produces residual stress of no more than 90 MPa through the thickness of the strip.

3. The method defined in claim 1 wherein step (a) of forming the metal coating on the steel strip includes hot-dip metal coating the strip in a bath of molten coating metal.

4. The method defined in claim 1 wherein step (a) of forming the metal coating on the steel strip includes the steps of recovery annealing steel strip and thereby producing high tensile strength steel strip and thereafter hot-dip metal coating the strip.

5. The method defined in claim 1 wherein step (b) of conditioning the steel strip smoothes the surface of the steel strip so that it is suitable for painting in a paint line.

6. The method defined in claim 1 wherein step (b) of conditioning the steel strip maintains the strip sufficiently flat for painting in a paint line.

7. The method defined in claim 1 wherein step (b) of conditioning the steel strip includes rolling the strip.

8. The method defined in claim 1 further including forming a paint coating on the conditioned strip produced in step (b).

9. The method defined in claim 7 wherein the rolling conditions are selected to produce residual stress of no more than 100 MPa.

10. The method defined in claim 9 wherein the rolling conditions are selected to produce residual stress of no more than 60 MPa.

11. The method defined in claim wherein the rolling conditions are selected to produce residual stress of no more than 50 MPa.

12. A method of producing a metal-coated steel strip which includes the steps of:

(a) forming a metal coating on a steel strip; and (b) conditioning the surface of the metal-coated steel strip by smoothing the surface of the strip, the conditioning step producing residual stress of no more than 100 MPa in the strip, and wherein step (a) of forming the metal coating on the steel strip includes recovery annealing the strip before forming the metal coating on the strip.

13. The method defined in claim 12 wherein step (b) of conditioning steel strip produces residual stress of no more than 90 MPa through the thickness of the strip.

14. The method defined in claim 12 wherein step (a) of forming the metal coating on the steel strip includes hot-dip metal coating the strip in a bath of molten coating metal.

15. The method defined in claim 12 wherein step (a) of forming the metal coating on the steel strip includes said step of recovery annealing steel strip to thereby produce high tensile strength steel strip and a step thereafter of hot-dip metal coating the strip.

16. The method defined in claim 12 wherein step (b) of conditioning the steel strip smoothes the surface of the steel strip so that it is suitable for painting in a paint line.

17. The method defined in claim 12 wherein step (b) of conditioning the steel strip maintains the strip sufficiently flat for painting in a paint line.

18. The method defined in claim 12 further including forming a paint coating on the conditioned strip produced in step (b).

19. The method defined in claim 12 wherein the steel strip is high tensile strength steel strip.

20. The method defined in claim wherein the tensile strength of the steel strip is at least 400 MPa.

21. The method defined in claim 12 wherein step (b) of conditioning the steel strip includes rolling the strip.

22. The method defined in claim 21 wherein the rolling conditions are selected to produce residual stress of no more than 100 MPa.

23. The method defined in claim 22 wherein the rolling conditions are selected to produce residual stress of no more than 60 MPa.

24. The method defined in claim 23 wherein the rolling conditions are selected to produce residual stress of no more than 50 MPa.

* * * * *